United States Patent [19]

Yonezawa et al.

[11] Patent Number: 4,548,868

[45] Date of Patent: Oct. 22, 1985

[54] SURFACE TREATMENT OF ZINC ALLOY ELECTROPLATED STEEL STRIPS

[75] Inventors: Kazuma Yonezawa; Toshikuni Tanda; Hirotake Ishitobi, all of Chiba, Japan

[73] Assignee: Kawasaki Steel Corporation, Kobe, Japan

[21] Appl. No.: 688,425

[22] Filed: Jan. 2, 1985

[30] Foreign Application Priority Data

Jan. 17, 1984 [JP] Japan ..... 59-6061

[51] Int. Cl.[4] ..... B32B 9/04; B05D 3/02; C23C 1/10

[52] U.S. Cl. ..... 428/446; 148/6.2; 204/40; 427/409; 428/460; 428/626; 428/641; 428/658; 428/667

[58] Field of Search ..... 427/409, 388.2; 148/6.2; 106/14.11, 14.13, 14.16; 428/626, 641, 658, 667, 460, 446; 204/40

[56] References Cited

U.S. PATENT DOCUMENTS

| | | | |
|---|---|---|---|
| 4,003,760 | 1/1977 | Labenski et al. | 148/6.2 |
| 4,032,675 | 6/1977 | Irie et al. | 427/126 |
| 4,221,832 | 9/1980 | Philippe et al. | 427/405 X |
| 4,373,968 | 2/1983 | Hess | 148/6.2 |
| 4,497,876 | 2/1985 | Kidon | 204/40 X |
| 4,500,610 | 2/1985 | Gunn et al. | 428/624 |

*Primary Examiner*—Thurman K. Page
*Attorney, Agent, or Firm*—Young & Thompson

[57] ABSTRACT

A surface coated steel strip having improved corrosion resistance, comprising a steel strip, a zinc alloy (e.g. Zn-Ni, Zn-Mn, Zn-Co, etc.) layer electroplated on the strip, a chromate film formed on the zinc alloy layer in a weight of 2 to 60 mg/m$^2$, and a polyethylene coating cured to the chromate film and weighing 0.3 to 5 g/m$^2$ is prepared by applying a chromate solution to the zinc alloy plated strip and drying it into the chromate film, and applying an aqueous composition of a carboxylated-polyethylene resin, a melamine resin, and colloidal silica to the chromated strip and drying and curing the composition into the coating at elevated temperatures of at least 130° C.

5 Claims, 2 Drawing Figures

SURFACE TREATMENT OF ZINC ALLOY ELECTROPLATED STEEL STRIPS

BACKGROUND OF THE INVENTION

This invention relates to the surface treatment of zinc alloy electroplated steel strips or sheets for outstandingly improving the corrosion resistance thereof and such treated zinc alloy electroplated steel strips.

The zinc alloy electroplated steel strips used herein designate composite zinc-plated steel strips, that is, steel strips having a zinc alloy layer electroplated thereon in which at least one metal is present in addition to zinc, including, for example, steel strips electroplated with Zn-Ni, Zn-Ni-Co, Zn-Ni-Cr, and Zn-Fe alloys.

A variety of electroplated steel strips have been employed in the manufacture of automobiles, electric appliances, and the like. There is a great need for surface treated steel strips having improved corrosion resistance and the demand for such steel strips appears increasing hereafter.

In general, zinc plating has long been used as a typical metal plating for improving the corrosion resistance of steel strips. The zinc plating is to protect steel strips from corrosion by the sacrificial corrosion protection effect of zinc itself. The amount of zinc deposited must be increased in order to enhance corrosion resistance. Increased amounts of zinc deposited, however, not only detract from the workability, weldability, and productivity of zinc plated steel, but also increase the cost. One method for improving the corrosion resistance of such zinc electroplated steel strips is by incorporating an additional metal or metals into the zinc plating to produce zinc alloy plated steel strips. There are well known techniques for electroplating such alloys as Zn-Ni, Zn-Ni-Co, Zn-Ni-Cr, and Zn-Fe.

The alloy plating methods mentioned above are successful to some extent in that since the resulting zinc alloy platings form passivated films effective in retarding or preventing dissolution of zinc, the corrosion resistance of composite zinc plated steel strips is improved by a factor of about 3 to 5 over that of conventional zinc plated steel strips and thus allows the amount of composite zinc platings deposited to be reduced. However, the composite zinc plated steel strips are still liable to formation of white rust and even red rust in relatively short time when they are allowed to stand indoors or outdoors and particularly when they are sprayed with water or salt water.

It was also proposed to carry out a chromate treatment after single or composite zinc plating in order to further improve corrosion resistance. The chromate treatment is effective, but not satisfactory to meet the needs of users in that white rust will appear after about 100 hours under high temperature and high humidity conditions and more under a salt-containing atmosphere.

We previously proposed particular coatings for improving corrosion resistance in Japanese Patent Appln. Kokai Nos. 58-100685 (a composition comprising a polyethylene resin in admixture with a water-soluble chromium compound), 58-153785 (a composition comprising a polyethylene resin in admixture with a melamine resin), and 58-177476 (a composition comprising a polyethylene resin in admixture with colloidal silica). It is zinc electroplated steel strips that are coated with these compositions. The application of these coatings extended the rust prevention time in a salt spray test to about 200 hours. In order to produce surface treated steel strips having further improved corrosion resistance, we have paid attention to zinc alloy plated steel strips because zinc, which offers an active surface liable to white rust formation when used alone, can be converted into a passivated or more corrosion resistant layer by alloying it with nickel, manganese, cobalt or the like. We have found that a synergistic corrosion preventing effect is accomplished when zinc alloy electroplated steel strips are subjected to a proper combination of chromate treatment and coating of a special coating composition.

SUMMARY OF THE INVENTION

It is, therefore, an object of the present invention to provide a novel and improved method for the surface treatment of a zinc alloy electroplated steel strip for providing extra corrosion resistance.

The extra corrosion resistance used herein means that white rust does not form in surface-treated steel strips after about 500 hours and red rust does not form after about 1500 hours of salt water spraying.

It is another object of the present invention to provide a surface treated steel strip having such extra corrosion resistance.

According to one aspect of the present invention, there is provided a method for surface treating a zinc alloy electroplated steel strip for improving the corrosion resistance, comprising the steps of forming a chromate film on the zinc alloy electroplated steel strip in a weight of 2 to 60 mg/m$^2$ of chromium, and applying an aqueous composition comprising 100 parts by weight of a dispersion of a carboxylated polyethylene resin having 3 to 20 mol % of carboxyl groups, 10 to 30 parts by weight of a water-soluble melamine resin, and 10 to 60 parts by weight of colloidal silica to the chromated strip, all the parts by weight being based on the solids of the respective components, and then drying the composition on the strip at a strip temperature of at least 130° C. to form a resinous coating in a weight of 0.3 to 5 g/m$^2$.

According to another aspect of the present invention, there is provided a zinc alloy electroplated steel strip having improved corrosion resistance, comprising a steel strip, a zinc alloy layer electroplated on the strip, a chromate film formed on the zinc alloy layer in a weight of 2 to 60 mg/m$^2$, and a coating cured to the chromate film and comprising 100 parts by weight of a polyethylene resin having 3 to 20 mol % of carboxyl groups, 10 to 30 parts by weight of a water-soluble melamine resin, and 10 to 60 parts by weight of colloidal silica and weighing 0.3 to 5 g/m$^2$.

Surface treated steel strips or sheets of this type are required to have excellent lacquer or paint adherence, spot weldability, solvent resistance, workability, and coating hardness as well as extra corrosion resistance. The surface treated steel strips or sheets of the present invention meet all these requirements as will be later illustrated in Examples.

The zinc alloy layers electroplated on steel strips according to the present invention may preferably be alloys of zinc with at least one metal selected from nickel, cobalt, manganese, chromium, and iron. Other alloying metals will occur to those skilled in the art.

Such a zinc alloy may be electroplated to a weight of at least 5 grams per square meter of steel surface.

BRIEF DESCRIPTION OF THE DRAWINGS

The surface treatment of zinc alloy electroplated steel strips according to the present invention will be more readily understood by reading the following description taken in conjunction with the accompanying drawings, in which.

DETAILED DESCRIPTION OF THE INVENTION

Figure 1:
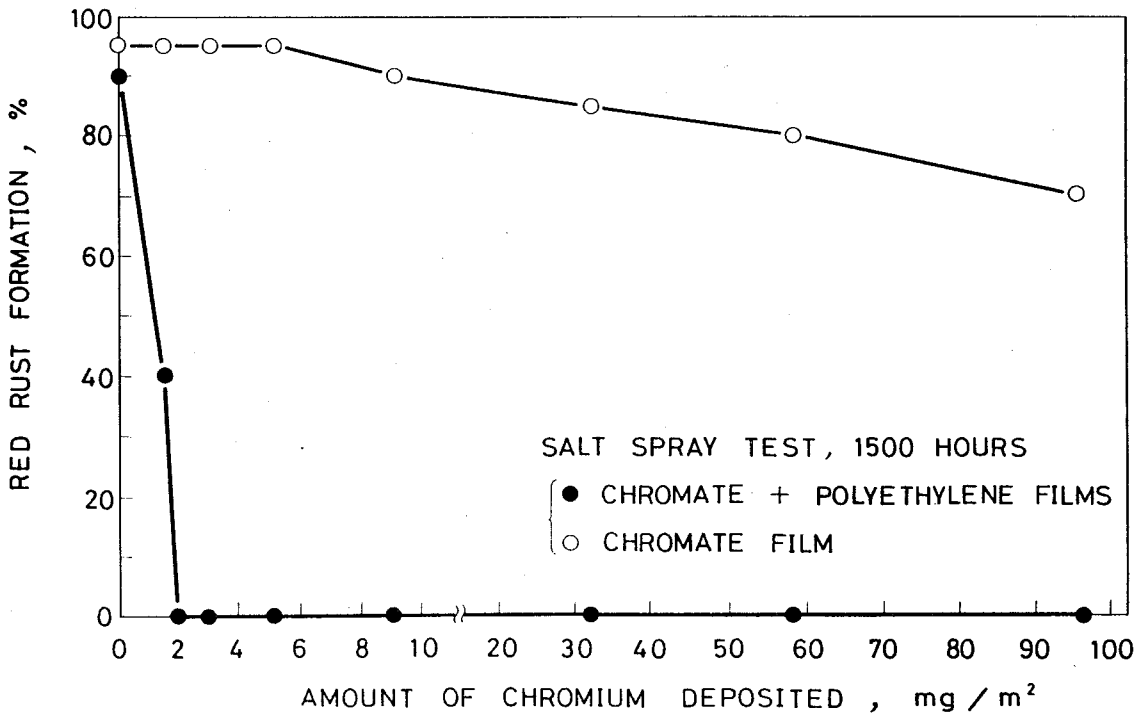
FIG. 1 is a diagram showing how the corrosion resistance of zinc-nickel alloy plated steel strips having a chromate film and a polyethylene coating varies with the chromium content of the chromate film when subjected to a salt spray test.

Experiments were carried out in order to determine the optimum ranges of the chromate film and resin coating on the surface treated steel strips according to the present invention.

Zinc-nickel alloy electroplated steel strips were treated in chromate solution so as to deposit varying amounts of chromium and then coated with a polyethylene resin composition. The coated strips were examined for corrosion resistance. The chromate treatment, resin coating, and corrosion test were carried out under the following conditions.

(1) Chromate Treatment or Undercoating

The starting steel strips are those having a thickness of 0.8 mm and electroplated with a zinc-nickel alloy (Ni 12.5%) to a weight of 20 grams per square meter ($g/m^2$). A chromate solution containing 30 grams/liter of chromium trioxide ($CrO_3$) and 4 grams/liter of sodium aluminum fluoride ($Na_3AlF_6$) was prepared and upon application, it was diluted with water to varying concentrations. The strips were coated with the chromate solutions of varying concentrations, squeezed by means of a flat rubber roll, and dried for 3 seconds with hot air at 85° C. The resulting chromate films contained chromium in the range of 1.5 to 96 $mg/m^2$.

(2) Polyethylene Coating or Overcoating

The steel strips chromated in (1) were coated with an aqueous composition which contained 100 parts by weight of a dispersion of a polyethylene resin having 10 mol % of carboxyl groups, 15 parts by weight of a water soluble melamine resin, and 20 parts by weight of colloidal silica, all the parts by weight being based on the solids of the respective components. The coated strips were then squeezed by means of a roll and dried for 30 seconds with hot air at 150° C. The resulting resin coatings all had a weight of 2.0 $g/m^2$.

(3) Corrosion Test

The corrosion test was carried out according to the procedure of salt spray test JIS Z 2371. The percent formation of red rust was determined after the test period of 1500 hours of spraying of 5% salt water.

In addition to samples having both a chromate film and a resin coating, samples having only a chromate film were also tested for comparison purpose. The results are plotted in FIG. 1 where the samples having both a chromate film and a resinous coating are designated by inked circles "•" and the comparative samples by blank circles "o". As seen from FIG. 1, red rust formed throughout the control sample (that is, zinc-nickel alloy plated steel) and substantially throughout the comparative samples having only a chromate film. By effecting a chromate treatment to deposit at least 2 $mg/m^2$ of chromium and applying a polyethylene coating in a weight of 2.0 $g/m^2$, the formation of red rust is controlled and extra corrosion resistance is achievable.

A further experiment was carried out in which chromated steel strips treated as above were coated with a polyethylene resin coating composition to varying thicknesses. The coated samples were examined for corrosion resistance. The composition and treating conditions of the chromate solution and the polyethylene resin coating composition were the same as in the previous experiment. The weight of chromium in the chromate film was fixed to 20 $mg/m^2$.

Figure 2:
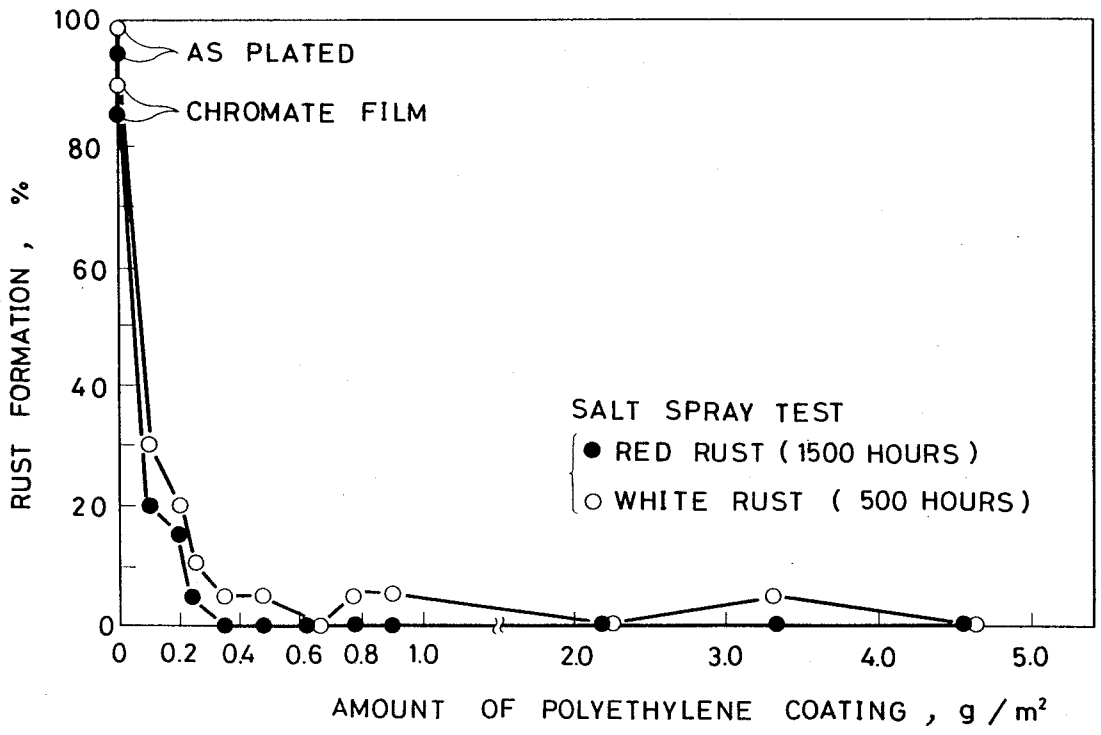
FIG. 2 is a diagram showing how the corrosion resistance of similar strips varies with the thickness of the polyethylene coating when subjected to a salt spray test.

In addition to samples having both a chromate film and a resin coating, samples having only a chromate film were also tested for comparison purpose. The results are plotted in FIG. 2 where data for red rust are designated by inked circles "•" and those for white rust by blank circles "o". As seen from FIG. 2, a copious amount of white rust formed after 500 hours of the salt spray test and a copious amount of red rust formed after 1500 hours of the test in the control sample (that is, zinc-nickel alloy plated steel) and the comparative samples having only a chromate film. By applying a polyethylene coating in a weight of at least 0.3 $g/m^2$, the formation of white rust and red rust is controlled and extra corrosion resistance is achievable.

The chromate solution and coating composition used herein will be illustrated in detail.

The chromate solution for providing an undercoating is mainly composed of chromic anhydride ($CrO_3$) and may contain, for example, etching and accelerating agents in the form of sulfuric acid or sulfates, phosphoric acid or phosphates, hydrofluoric acid or fluorides, boric acid, salt (sodium chloride), and the like. The chromate solution may be either of the reaction type or of the coating type as long as they can yield a chromate film mainly composed of hydrated chromium oxides in a weight of 2 to 60 $mg/m^2$ of chromium. Chromium weights of less than 2 $mg/m^2$ are insufficient to provide corrosion resistance whereas the appearance of products is impaired at chromium weights of more than 60 $mg/m^2$ due to non-uniform coating thickness and inconsistent color tone. The chromate solution may be applied by any well-known techniques including spraying, dipping, and roll coating followed by squeezing with a roll or air knife, and then by hot air drying.

The coating composition which may be used to form a polyethylene resin overcoating is comprised of a carboxylated polyethylene resin dispersion, a melamine resin, and colloidal silica as mentioned above. The polyethylene resins used herein are those polyethylene resins having 3 to 20 mol % of carboxyl groups attached thereto. Although ethylene-vinyl acetate emulsions and polyethylene waxes are generally included in polyethylene resins, they result in less corrosion resistant coatings. No water-soluble polyethylene resin is available at present. Carboxylated-polyethylene resins have been found optimum for the present invention. Polyethylene resins having less than 3 mol % of carboxyl groups cannot be fully emulsion polymerized and thus result in less adherent coatings whereas polyethylene resins having more than 20 mol % of carboxyl groups result in coatings which are deteriorated in such properties as corrosion resistance. The polyethylene resins used herein may be either homopolymers or copolymers.

The water-soluble melamine resin is used as a crosslinking agent in amounts of 10 to 30 parts by weight per 100 parts by weight of the solids of the carboxylated polyethylene resin dispersion. Good coating hardness and solvent resistance are not achieved with less than 10 parts by weight of the melamine resin. More than 30 parts weight of the melamine resin causes the composition to be gelled to reduce its pot life and adversely affects the corrosion resistance of the resulting coatings. The crosslinking melamine resins are thermosetting melamine-formaldehyde resins such as methylol melamine resins which are commercially available from various manufacturers.

The colloidal silica is used in amounts of 10 to 60 parts per 100 parts by weight of the solids of the carboxylated polyethylene resin dispersion. The colloidal silica is included in order to improve the hardness and corrosion resistance of coatings. Less than 10 parts by weight of colloidal silica fails to provide sufficient coating hardness whereas more than 60 parts by weight adversely affects the corrosion resistance and paint adherence. The colloidal silica used herein is also commercially available in aqueous dispersion form.

The polyethylene based coating should preferably have a weight in the range of 0.3 to 5 g/m$^2$. Coatings of less than 0.3 g/m$^2$ are too thin to provide good corrosion resistance. Coatings of more than 5 g/m$^2$ provide good corrosion resistance, but disturb spot welding.

The composition may be applied to steel strips by any well-known techniques including roll coating and dipping/grooved roll squeezing. The composition may be adjusted to any desired concentration depending on the particular coating technique employed.

The applied composition is then dried into a coating with hot air while the underlying strip should be heated to a temperature of at least 130° C. Heat is applied for evaporating off the water and crosslinking the resins. The coating does not harden to a sufficient hardness at strip temperatures of less than 130° C. Increasing the strip temperature more than necessary is not economically desirable.

Examples of the present invention are given below by way of illustration and not by way of limitation.

EXAMPLE 1

A steel strip which had been electroplated with a zinc-nickel alloy (Ni 12.5 wt %) to a weight of 20 g/m$^2$ was spray coated with an undercoating chromate solution containing 20 grams/liter of $CrO_3$ and 4 grams/liter of $Na_3AlF_6$, squeezed by means of a flat rubber roll, and dried with hot air. The weight of chromium deposited was 20 mg/m$^2$. This chromate treated strip was further coated with an aqueous composition composed of 100 parts by weight of a dispersion of a carboxylated polyethylene resin containing 12 mol % of carboxyl groups, 15 parts by weight of a water-soluble melamine resin, and 20 parts by weight of colloidal silica, all the parts by weight being based on the solids of the respective components. A resin coating having a weight of 2.5 g/m$^2$ was obtained by drying the applied composition at a strip temperature of 135° C.

EXAMPLE 2

A steel strip which had been electroplated with a zinc-nickel alloy (Ni 12.5 wt %) to a weight of 20 g/m$^2$ was spray coated with an undercoating chromate solution containing 10 grams/litter of $CrO_3$ and 2 grams/litter of $Na_3AlF_6$, squeezed by means of a flat rubber roll, and dried with hot air. The weight of chromium deposited was 16 mg/m$^2$. This chromate treated strip was further coated with an aqueous composition composed of 100 parts by weight of the same carboxylated-polyethylene resin dispersion as used in Example 1, 20 parts by weight of a water-soluble melamine resin, and 30 parts by weight of colloidal silica, all the parts by weight being based on the solids of the respective components. A resin coating having a weight of 1.8 g/m$^2$ was obtained by drying the applied composition at a strip temperature of 140° C.

EXAMPLE 3

A steel strip which had been electroplated with a zinc-nickel alloy (Ni 12.5 wt %) to a weight of 20 g/m$^2$ was spray coated with an undercoating chromate soution containing 10 grams/litter of $CrO_3$, 2 grams/litter of $Na_3AlF_6$, and 40 grams/litter of colloidal silica and then squeezed and dried in the same manner as in Example 1. The weight of chromium deposited was 10 mg/m$^2$. This chromate treated strip was further coated with an aqueous composition composed of 100 parts by weight of a dispersion of a carboxylated-polyethylene resin containing 10 mol % of carboxyl groups, 16 parts by weight of a water-soluble melamine resin, and 15 parts by weight of colloidal silica, all the parts by weight being based on the solids of the respective components. A resin coating having a weight of 3.8 g/m$^2$ was obtained by drying the applied composition at a strip temperature of 150° C.

Comparative Example 1

This example illustrates the control, that is, the zinc-nickel alloy electroplated steel strip having a plating weight of 20 g/m$^2$ as used in Example 1.

Comparative Example 2

This example illustrates the steel sample which was coated with a chromate film after zinc-nickel alloy plating in Example 1. That is, a zinc-nickel alloy electroplated steel strip was spray coated with an undercoating chromate solution containing 20 grams/liter of $CrO_3$ and 4 grams/liter of $Na_3AlF_6$, squeezed by means of a flat rubber roll, and dried with hot air. The weight of chromium deposited was 20 mg/m$^2$.

Comparative Example 3

The steel sample of Comparative Example 2 was further coated with an aqueous composition containing 12% by weight of a polyacrylic acid, which was dried into a coating of 2.5 g/m$^2$.

The samples of surface treated or coated steel prepared in Examples 1 to 3 and Comparative Examples 1 to 3 were subjected to various tests as listed below. The results are shown in Table I.

(1) Corrosion resistance

A salt spray test was carried out according to JIS Z 2371. The percent formation of rust was determined at the end of the test period.

(2) Coating hardness

The hardness of the resinous coating was expressed in pencil hardness.

(3) Spot weldability

A continuous welding test was carried out by using a stationary spot welding machine and repeating spot weldings until the nugget diameter reached 4 mm.
O—5000 spots or more
X—less than 5000 spots (4) Paint adherence A melamine alkyd resin type paint was applied to samples and baked at 150° C. for 30 minutes into a paint film of 25 μm thick. The paint film was scribed and an Erichsen test was carried out by extruding the scribed sample by 7 mm. The sample was examined whether the paint film sections were peeled.
O—No peeling
Δ—Some peeling
X—Substantial peeling (5) Solvent resistance A rubbing test was carried out by rubbing the sample surface with cotton impregnated with methylene chloride.
O—No change
X—Dissolved away (6) Coating adherence A scribing peel test using a Scotch adhesive tape and a zero T-bend test were carried out.
O—No peeling
X—Peeled Comparative Example 4

This example is in accord with Japanese Patent Application Kokai No. 58-100685 (laid open on June 15, 1983).

A steel strip which had been electroplated with zinc to a weight of 20 g/m$^2$ was spray coated with an undercoating chromate solution containing 10 grams/liter of $CrO_3$ and 2 grams/liter of $H_2SiF_6$, squeezed by means of a flat rubber roll, and dried with hot air. The weight of chromium deposited was 40 mg/m$^2$. This chromate treated strip was dipped in an aqueous composition composed of 10 wt % of a carboxylated polyethylene resin and 0.6 wt % of chromic anhydride. An overcoat having a weight of 1.4 g/m$^2$ was obtained after drying at 150° C.

Comparative Example 5

This example is in accord with Japanese Patent Application Kokai No. 58-153785 (laid open on Sept. 13, 1983).

A steel strip which had been electroplated with zinc to a weight of 20 g/m$^2$ was spray coated with an undercoating chromate solution containing 10 grams/liter of $CrO_3$ and 2 grams/liter of $H_2SiF_6$, squeezed by means of a flat rubber roll, and dried with hot air. The weight of chromium deposited was 28 mg/m$^2$. This chromate treated strip was further coated with an aqueous composition composed of 100 parts by weight of a dispersion of a carboxylated-polyethylene resin containing 10 mol % of carboxyl groups, 15 parts by weight of a water-soluble melamine resin, and 5 parts by weight of ammonium chromate, the parts by weight of the former two components being based on their solids. A resin coating having a weight of 1.6 g/m$^2$ was obtained after drying at 135° C.

Comparative Example 6

This example is in accord with Japanese Patent Application Kokai No. 58-177476 (laid open on Oct. 18, 1983).

A steel strip which had been electroplated with zinc to a weight of 20 g/m$^2$ was spray coated with an undercoating chromate solution containing 10 grams/liter of $CrO_3$ and 2 grams/liter of $H_2SiF_6$, squeezed by means of a flat rubber roll, and dried with hot air. The weight of chromium deposited was 38 mg/m$^2$. This chromate treated strip was further coated with an aqueous composition composed of 100 parts by weight of a dispersion of a carboxylated-polyethylene resin containing 10 mol % of carboxyl groups, 30 parts by weight of colloidal silica, and 3 parts by weight of ammonium chromate, the parts by weight of the former two components being based on their solids. A resin coating having a weight of 1.7 g/m$^2$ was obtained after drying at 145° C.

Comparative Example 7

This example illustrates the coating of a Zn plated steel strip with a coating composition according to the present invention.

A steel strip which had been electroplated with zinc to a weight of 20 g/m$^2$ was spray coated with an undercoating chromate solution containing 10 grams/liter of $CrO_3$ and 2 grams/liter of $H_2SiF_6$, squeezed by means of a flat rubber roll, and dried with hot air. The weight of chromium deposited was 38 mg/m$^2$. This chromate treated strip was further coated with an aqueous composition composed of 100 parts by weight of a dispersion of a carboxylated-polyethylene resin containing 12 mol % of carboxyl groups, 15 parts by weight of a water-soluble melamine resin, and 20 parts by weight of colloidal silica, all the parts by weight being based on the solids of the respective components. A resin coating having a weight of 1.0 g/m$^2$ was obtained by drying the applied composition at a strip temperature of 140° C.

The results are shown in Table I.

TABLE I

| | Coating Composition (parts by weight) | | | | | | |
|---|---|---|---|---|---|---|---|
| | Plating 20 g/m$^2$ | Cr deposited (mg/m$^2$) | COOH—PE[1] (COOH mol %) | Melamine resin | Colloidal silica | Drying temp. (°C.) | Coating weight (g/m$^2$) |
| Range of Invention | | | | | | | |
| | Zn alloy | 2–60 | 100 (3–20%) | 10–30 | 10–60 | ≧130 | 0.3–5 |
| Example | | | | | | | |
| 1 | Zn—12.5Ni | 20 | 100 (12%) | 15 | 20 | 135 | 2.5 |
| 2 | Zn—12.5Ni | 16 | 100 (12%) | 20 | 30 | 140 | 1.8 |
| 3 | Zn—12.5Ni | 10 | 100 (10%) | 16 | 15 | 150 | 3.8 |
| Comparative Example | | | | | | | |

TABLE I-continued

| | | | | | | | |
|---|---|---|---|---|---|---|---|
| 1 | Zn—12.5Ni | — | — | — | — | — | — |
| 2 | Zn—12.5Ni | 20 | — | — | — | — | — |
| 3 | Zn—12.5Ni | 20 | Polyacrylic acid | — | — | — | 2.5 |
| 4 | Zn | 40 | 100 | 6 $CrO_3$ | — | 150 | 1.4 |
| 5 | Zn | 28 | 100 (10%) | 15 | 5 $(NH_4)_2CrO_4$ | 135 | 1.6 |
| 6 | Zn | 38 | 100 (10%) | 3 $(NH_4)_2CrO_4$ | 30 | 145 | 1.7 |
| 7 | Zn | 40 | 100 (12%) | 20 | 30 | 140 | 1.0 |

| | Salt spray test[2] | | Coating | Spot | Paint | Solvent | Coating |
|---|---|---|---|---|---|---|---|
| | White rust | Red rust | hardness | weldability | adherence | resistance | adherence |
| Example | | | | | | | |
| 1 | 10 | 0 | 3H | O | O | O | O |
| 2 | 5 | 0 | 3H | O | O | O | O |
| 3 | 0 | 0 | 3H | O | O | O | O |
| Comparative Example | | | | | | | |
| 1 | 100 | 95 | H | O | Δ | O | — |
| 2 | 85 | 85 | 2H | O | O | O | — |
| 3 | 60 | 40 | B | X | O | X | O |
| 4 | 60 | 35 | 2B | O | O | X | O |
| 5 | 50 | 20 | 2H | O | O | O | O |
| 6 | 40 | 20 | 2H | O | O | O | O |
| 7 | 30 | 5 | 3H | O | O | O | O |

[1]Carboxylated polyethylene; figures in parentheses represent contents of carboxyl groups in the polyethylene in mol %.
[2]Salt spray test according to JIS Z 2371, percentage formation of white rust after 500 hours, percentage formation of red rust after 1500 hours.

The data for Comparative Examples 1 and 2 shows that the zinc alloy plating and the chromate film as exposed do not protect steel from rust. The data for Comparative Example 3 shows that a coat of polyacrylic acid is less rust preventive on zinc alloy plated steel with a chromate film. The data for Comparative Examples 4, 5, and 6 shows that although the previously proposed coating compositions are satisfactorily rust preventive on zinc plated steel strips in a 200 hour salt spray test, they are not satisfactory in an extended (500 hour) salt spray test. The data for Comparative Example 7 shows that the coating composition of the present invention is not fully satisfactory in rust prevention when applied to zinc plated steel strips.

It is thus evident that the coating composition of the present invention is fully effective in rust protection only when applied to zinc alloy plated steel via a chromate film.

EXAMPLE 4

A steel strip which had been electroplated with a zinc-manganese alloy (Mn 21.0 wt %) to a weight of 30 g/m$^2$ was spray coated with an undercoating chromate solution containing 20 grams/liter of $CrO_3$, 2 grams/liter of $Na_3AlF_6$, and 40 grams/liter of colloidal silica, squeezed by means of a fluted rubber roll, and dried with hot air. The weight of chromium deposited was 50 mg/m$^2$. This chromate treated strip was further coated with an aqueous composition composed of 100 parts by weight of a dispersion of a carboxylated-polyethylene resin containing 12 mol % of carboxyl groups, 20 parts by weight of a water-soluble melamine resin, and 20 parts by weight of colloidal silica, all the parts by weight being based on the solids of the respective components. A resin coating having a weight of 2.1 g/m$^2$ was obtained by drying the applied composition at a strip temperature of 140° C.

EXAMPLE 5

A steel strip which had been electroplated with a zinc-cobalt alloy (Co 5.0 wt %) to a weight of 30 g/m$^2$ was spray coated with an undercoating chromate solution containing 20 grams/liter of $CrO_3$, 3 grams/liter of $Na_3AlF_6$, and 30 grams/liter of colloidal silica, squeezed by means of a flat rubber roll, and dried with hot air. The weight of chromium deposited was 45 mg/m$^2$. This chromate treated strip was further coated with an aqueous composition composed of 100 parts by weight of a dispersion of a carboxylated polyethylene resin containing 12 mol % of carboxyl groups, 15 parts by weight of a water-soluble melamine resin, and 20 parts by weight of colloidal silica, all the parts by weight being based on the solids of the respective components. A resin coating having a weight of 2.3 g/m$^2$ was obtained by drying the applied composition at a strip temperature of 140° C.

The samples prepared in Examples 4 and 5 were subjected to the same tests as above. The results are shown in Table II.

TABLE II

| | Coating Composition (parts by weight) | | | | | | |
|---|---|---|---|---|---|---|---|
| Example | Plating | Cr deposited (mg/m$^2$) | COOH—PE[1] (COOH mol %) | Melamine resin | Colloidal silica | Drying temp. (°C.) | Coating weight (g/m$^2$) |
| 4 | Zn—21.0Mn 30 g/m$^2$ | 50 | 100 (12%) | 20 | 20 | 140 | 2.1 |
| 5 | Zn—5.0Co 30 g/m$^2$ | 45 | 100 (12%) | 15 | 20 | 140 | 2.3 |

| | Salt spray test[2] | | Coating | Spot | Paint | Solvent | Coating |
|---|---|---|---|---|---|---|---|
| Example | White rust | Red rust | hardness | weldability | adherence | resistance | adherence |
| 4 | 5 | O | 3H | O | O | O | O |

TABLE II-continued

| | | | | | | | |
|---|---|---|---|---|---|---|---|
| 5 | 5 | O | 3H | O | O | O | O |

[1]Carboxylated polyethylene; figures in parentheses represent contents of carboxyl groups in the polyethylene in mol %.
[2]Salt spray test according to JIS Z 2371, percentage formation of white rust after 500 hours, percentage formation of red rust after 1500 hours.

As seen from the above data, the present invention provides surface coated steel strips which not only meet the extra corrosion resistance required particularly for steel strips useful in the manufacture of automobiles and electric appliances, but also exhibit excellent spot weldability, paint adhesion and solvent resistance. It is also demonstrated that the present invention is equally applicable to steel strips having any zinc alloys electroplated including zinc-manganese and zinc-cobalt alloys as well as zinc-nickel alloy.

Although the present invention is described with reference to the particular embodiments, other modifications and variations may be made by those skilled in the art without departing from the scope and spirit of the present invention.

What is claimed is:

1. A method for surface treating a zinc alloy electroplated steel strip for improving the corrosion resistance, comprising the steps of forming a chromate film on the zinc alloy electroplated steel strip in a weight of 2 to 60 mg/m$^2$ of chromium, and applying an aqueous composition comprising 100 parts by weight of a dispersion of a carboxylated polyethylene resin having 3 to 20 mol % of carboxyl groups, 10 to 30 parts by weight of a water-soluble melamine resin, and 10 to 60 parts by weight of colloidal silica to the chromated strip, all the parts by weight being based on the solids of the respective components, and then drying the composition on the strip at a strip temperature of at least 130° C. to form a resinous coating in a weight of 0.3 to 5 g/m$^2$.

2. The method according to claim 1 wherein the zinc alloy is selected from alloys of zinc with at least one metal selected from nickel, manganese, cobalt, chromium, and iron.

3. The method according to claim 1 wherein the chromate film is formed by applying a chromate solution to the electroplated strip followed by drying.

4. A zinc alloy electroplated steel strip having improved corrosion resistance, comprising a steel strip, a zinc alloy layer electroplated on the strip, a chromate film formed on the zinc alloy layer in a weight of 2 to 60 mg/m$^2$, and a coating cured to the chromate film and comprising 100 parts by weight of a polyethylene resin having 3 to 20 mol % of carboxyl groups, 10 to 30 parts by weight of a water-soluble melamine resin, and 10 to 60 parts by weight of colloidal silica and weighing 0.3 to 5 g/m$^2$.

5. The strip according to claim 4 wherein the zinc alloy is selected from alloys of zinc with at least one metal selected from nickel, manganese, cobalt, chromium, and iron.

* * * * *